US007045942B2

(12) United States Patent
Shimizu et al.

(10) Patent No.: US 7,045,942 B2
(45) Date of Patent: May 16, 2006

(54) COLOR PICTURE TUBE

(75) Inventors: Norio Shimizu, Ibaraki (JP); Fumiaki Nihei, Ibaraki (JP); Toshio Uchikawa, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/142,135

(22) Filed: Jun. 1, 2005

(65) Prior Publication Data

US 2005/0269930 A1 Dec. 8, 2005

(30) Foreign Application Priority Data

Jun. 1, 2004 (JP) ..... 2004-163148

(51) Int. Cl.
*H01J 29/81* (2006.01)

(52) U.S. Cl. ..... 313/402; 313/461; 313/477 R

(58) Field of Classification Search ..... 313/402, 313/477 R, 461; 220/2.1 A
See application file for complete search history.

(56) References Cited

U.S. PATENT DOCUMENTS

| | | | | |
|---|---|---|---|---|
| 4,881,004 | A * | 11/1989 | Inoue et al. | 313/408 |
| 5,107,999 | A * | 4/1992 | Canevazzi | 220/2.1 A |
| 5,155,410 | A * | 10/1992 | Wakasono et al. | 313/402 |
| 5,274,303 | A * | 12/1993 | Bakker et al. | 313/477 R |
| 6,025,676 | A | 2/2000 | Ohama et al. | |
| 6,559,589 | B1 * | 5/2003 | Yoon | 313/461 |
| 6,639,347 | B1 * | 10/2003 | Ko | 313/461 |
| 6,650,036 | B1 * | 11/2003 | Nakagawa et al. | 313/402 |
| 6,765,344 | B1 * | 7/2004 | Yoshida et al. | 313/477 R |
| 6,841,927 | B1 * | 1/2005 | Lee | 313/474 |
| 2004/0000860 | A1 | 1/2004 | Jung | |
| 2005/0285499 | A1 * | 12/2005 | Pyun et al. | 313/477 R |

FOREIGN PATENT DOCUMENTS

| | | |
|---|---|---|
| EP | 0 578 251 | 1/1994 |
| EP | 0 692 810 | 1/1996 |
| EP | 1 061 548 | 12/2000 |
| EP | 1 089 313 | 4/2001 |
| EP | 1 115 139 | 7/2001 |
| EP | 1 258 904 | 11/2002 |
| JP | 10-199436 | 7/1998 |
| JP | 2004-31305 | 1/2004 |

* cited by examiner

*Primary Examiner*—Ashok Patel
*Assistant Examiner*—Christopher Raabe
(74) *Attorney, Agent, or Firm*—Hamre, Schumann, Mueller & Larson, P.C.

(57) ABSTRACT

The radius of curvature of the outer surface of a panel is 10,000 mm or more, and a shadow mask is made of a material containing 95% or more of iron. A sagging amount change curve along a curve C1 on the surface of the shadow mask, which a plane passing through a center P0 of a useful area of the shadow mask and parallel to a tube axis and a major axis crosses, satisfies a particular Condition 1. Assuming that an intersection between the curve C1 and a useful area end of the shadow mask is a major axis end PL, a distance from the center P0 to the major axis end PL along a major axis is W, and a point on the curve C1 away from the center P0 by ⅔×W in the major axis direction is P1, a sagging amount change curve along a curve C2 on the surface of the shadow mask, which a plane passing through the point P1 and parallel to the tube axis and the minor axis crosses, satisfies a particular Condition 2. Consequently, a color picture tube can be realized, which has satisfactory visibility, and less degradation in color purity caused by doming while having a shadow mask made of an inexpensive material with satisfactory moldability.

6 Claims, 9 Drawing Sheets

COLOR PICTURE TUBE

BACKGROUND OF THE INVENTION

1. Field of the Invention

The present invention relates to a color picture tube provided with a shadow mask.

2. Description of the Related Art

In general, as shown in FIG. 1, a color picture tube includes an envelope composed of a substantially rectangular panel 3 in which a skirt portion 2 is provided on the periphery of a useful surface 1 formed of a curved surface, and a funnel 4 in a funnel shape connected to the skirt portion 2. A substantially rectangular shadow mask 7 having a curved surface, in which a number of electron beam passage apertures 6 are formed, is placed so as to be opposed to a phosphor screen 5 composed of three-color phosphor layers formed on an inner surface of the useful surface 1 of the panel 3. The shadow mask 7 is held by a substantially rectangular mask frame 8. A shadow mask structure 9 composed of the shadow mask 7 and the mask frame 8 is supported detachably with respect to the panel 3 with one end of a substantially V-shaped elastic support 15 attached to each corner portion or respectively on a short side and a long side of the mask frame 8, and the other end of the elastic support 15 engaged with a stud pin 16 fixed on an inner wall of the skirt portion 2 of the panel 3. An electron gun 12 emitting three electron beams 11 is housed in a neck 10 of the funnel 4. The three electron beams 11 emitted by the electron gun 12 are deflected by a magnetic field generated by a deflection apparatus 13 mounted on an outer side of the funnel 4, and allowed to scan the phosphor screen 5 in horizontal and vertical directions via the shadow mask 7, thereby displaying a color image.

In general, in order to display an image without any color displacement on the phosphor screen 5 of the color picture tube, the three electron beams 11 passing through the electron beam passage apertures 6 formed in the shadow mask 7 should land correctly on the three-color phosphor layers of the phosphor screen 5 respectively.

Recently, in order to enhance the visibility of the color picture tube, there is a demand for decreasing the curvature of the outer surface of the useful surface 1 of the panel 3 so as to make the shape of the outer surface substantially flat. Along with this, it also is necessary to decrease the curvature of the inner surface of the useful surface 1 of the panel 3 in terms of the explosion protection and visibility.

Furthermore, in order to allow the electron beams to land appropriately at desired positions of the inner surface of the panel 1, it is necessary to appropriately keep an interval q between the panel 3 and the shadow mask 7, and decrease the curvature of the shadow mask 7 having the electron beam passage apertures 6 in accordance with the curvature of the inner surface of the panel 3.

According to a shadow mask type color picture tube, in its operational principle, the relative amount of the electron beams 11 that pass through the electron beam passage apertures 6 of the shadow mask 7 to reach the phosphor screen 5 is ⅓ or less of the total amount of the electron beams emitted by the electron gun 12, and the other electron beams strike the shadow mask 7 to be converted into thermal energy. Thus, a so-called doming phenomenon occurs. That is, the shadow mask 7 is heated to expand thermally, and consequently, is deformed so as to swell on the phosphor screen 5 side. When the interval q between the phosphor screen 5 and the shadow mask 7 exceeds an allowable range due to the doming, the landing position of the electron beams 11 with respect to the phosphor screen 5 shifts to degrade color purity.

The magnitude of the landing positional shift of the electron beams 11 caused by the thermal expansion of the shadow mask 7 varies largely depending upon the brightness of an image pattern and the duration time of the pattern. Particularly, in the case of locally displaying an image pattern with high brightness, local doming occurs, and a local landing positional shift occurs within a short period of time. In the local doming, the amount of the landing positional shift is large.

As shown in FIG. 13, it is assumed that a center of the shadow mask 7 (i.e., a point where a tube axis (Z-axis) crosses) is P0, an axis orthogonal to the tube axis and parallel to a long side is a major axis (X-axis), and an axis orthogonal to the tube axis and the major axis and parallel to a short side is a minor axis (Y-axis). Furthermore, it is assumed that an interval between the center P0 and an useful area end of the shadow mask 7 along the major axis is W. The above-mentioned local doming occurs most remarkably in the case where a pattern with high brightness is displayed in an area on the phosphor screen 5 corresponding to an oval area 30 including a point P1 on the major axis away from the center P0 by (⅔)×W, and the landing positional shift of the electron beams in the area on the phosphor screen 5 corresponding to the area 30 is largest.

When the curvature of the shadow mask 7 decreases, the doming amount increases. Therefore, the amount of the landing positional shift of the electron beams also increases, and the color purity degrades remarkably. Consequently, in a color picture tube in which the outer surface of the useful surface 1 of the panel 3 is substantially flat, in order to suppress doming, an alloy mainly containing iron and nickel, having a low coefficient of thermal expansion, is used generally as a material for the shadow mask 7. For example, an iron-nickel alloy such as 36 Ni Invar alloy (see Table 3 described later) is used. Such an alloy entails high cost, while having a coefficient of thermal expansion of 1 to $2\times10^{-6}$ at 0° C. to 100° C., and being effective for suppressing doming. Furthermore, the iron-nickel alloy has large elasticity after annealing, so that it is difficult to form a curved surface from such an alloy by molding and to obtain a desired curved surface. Even if the iron-nickel alloy is annealed, for example, at a high temperature of 900° C., the yield point strength is about $28\times10^7$ N/m$^2$. Thus, it is necessary to treat the alloy at a considerably high temperature in order to set the yield point strength to be $20\times10^7$ N/m$^2$ or less at which molding generally is considered to be easy. Particularly, in a color picture tube with a flat panel outer surface, the curvature of the shadow mask 7 is small, so that molding is further difficult.

In the case where molding is insufficient, and undesired stress remains in the shadow mask 7 after molding, the residual stress changes the shape of the shadow mask 7 in the course of production of the color picture tube, which leads to the landing positional shift of the electron beams, resulting in the significant degradation in color purity.

On the other hand, with a material mainly containing iron with high purity, the yield point strength can be set to be $20\times10^7$ N/m$^2$ or less by annealing at about 800° C., so that molding is very easy. Thus, it is not necessary to keep the mold temperature to be high in the course of molding, which is required in an Invar alloy, and the productivity also is satisfactory.

However, the coefficient of thermal expansion of the material mainly containing iron with high purity is high (i.e., about $12\times10^{-6}$ at 0° C. to 100° C.), which is disadvantageous for doming. Particularly, in the case of applying such a material to a color picture tube in which the outer surface of the useful surface 1 of the panel 3 is substantially flat, there arises a serious problem such as the significant degradation in color purity.

JP 10(1998)-199436 A discloses a shadow mask in the shape of a substantially cylindrical surface, in which the radius of curvature in a major axis direction is almost infinite, and the radius of curvature in a minor axis direction is almost constant irrespective of the position in the major axis direction. Even such a shadow mask has an effect of suppressing doming to some degree. However, in the case of using an inexpensive iron material, a sufficient effect cannot be obtained.

Furthermore, JP 2004-31305 A discloses a cathode-ray tube using an inexpensive iron material for a shadow mask by defining the radius of curvature of a panel inner surface. However, in this cathode-ray tube, a sufficient effect of suppressing doming cannot be obtained, either, in the same way as in JP 10(1998)-199436 A. When an attempt is made to obtain a sufficient effect of suppressing doming, the weight of a panel increases, compared with the case of using an expensive Invar material.

As described above, in the case of decreasing the curvature of the outer surface of the useful surface 1 of the panel 3 so as to enhance the visibility, when an alloy mainly containing iron and nickel is used as a material for the shadow mask 7, it is difficult to form a curved surface by molding, and a desired curved surface may not be obtained. On the other than, when an inexpensive iron material with satisfactory moldability is used, the landing positional shift of the electron beams occurs due to the local doming of the shadow mask 7 during an operation of a color picture tube, causing a phosphor other than the phosphors, which are supposed to emit light, to emit light, resulting in the degradation in color purity of the color picture tube.

SUMMARY OF THE INVENTION

Therefore, with the foregoing in mind, it is an object of the present invention to provide a color picture tube that has satisfactory visibility, and less degradation in color purity caused by doming while having a shadow mask made of an inexpensive material with satisfactory moldability.

A color picture tube of the present invention includes: a panel; a phosphor screen in a substantially rectangular shape, formed on an inner surface of the panel; and a shadow mask in which a number of electron beam passage apertures are formed, placed so as to be opposed to the phosphor screen. A radius of curvature of an outer surface of the panel is 10,000 mm or more. The shadow mask is made of a material containing 95% or more of iron.

In a first color picture tube of the present invention, assuming that a distance from a reference point to a useful area end on the shadow mask in a direction vertical to a tube axis is L, and a sagging amount at the useful area end with respect to the reference point in a tube axis direction is Ze, a first sagging amount curve representing a first sagging amount Z1 at a point at a distance d from the reference point in the direction vertical to the tube axis, represented by the following Formula 1, and a second sagging amount curve representing a second sagging amount Z2 at a point at the distance d from the reference point in the direction vertical to the tube axis, represented by the following Formula 2, are defined. A sagging amount change curve along a curve C1 on a surface of the shadow mask, which a plane passing through a center P0 of a useful area of the shadow mask and parallel to the tube axis and a major axis crosses, satisfies the following Condition 1. Furthermore, assuming that an intersection between the curve C1 and the useful area end of the shadow mask is a major axis end PL, a distance from the center P0 to the major axis end PL along the major axis is W, and a point on the curve C1 away from the center P0 by ⅔×W in a major axis direction is P1, a sagging amount change curve along a curve C2 on the surface of the shadow mask, which a plane passing through the point P1 and parallel to the tube axis and a minor axis crosses, satisfies the following Condition 2.

$$Z1=\{(Ze\cdot(1-rf1))/L^2\}d^2+\{(Ze\cdot rf1)/L^4\}\cdot d^4 \qquad \text{Formula 1}$$

$$Z2=\{(Ze\cdot(1-rf2))/L^2\}d^2+\{(Ze\cdot rf2)/L^4\}\cdot d^4 \qquad \text{Formula 2}$$

Condition 1: Assuming that a sagging amount at the major axis end PL with respect to the center P0 is ZPL, at least 60% portion of the sagging amount change curve along the curve C1 between the center P0 and the major axis end PL is present between the first sagging amount curve represented by the Formula 1 and the second sagging amount curve represented by the Formula 2, where L=W, Ze=ZPL, rf1=0.7, rf2=1.2, Condition 2: Assuming that an intersection between the curve C2 and the useful area end of the shadow mask is P2, a distance from the point P1 to the point P2 in a minor axis direction is H2, and a sagging amount at the point P2 with respect to the point P1 is ZP2, at least 60% portion of the sagging amount change curve along the curve C2 between the point P1 and the point P2 is present between the first sagging amount curve represented by the Formula 1 and the second sagging amount curve represented by the Formula 2, where L=H2, Ze=ZP2, rf1=−0.4, rf2=0.

In a second color picture tube of the present invention, assuming that a distance from a reference point to a useful area end on the inner surface of the panel in a direction vertical to a tube axis is L', and a sagging amount at the useful area end with respect to the reference point in a tube axis direction is Ze', a first sagging amount curve representing a first sagging amount Z1' at a point at a distance d' from the reference point in the direction vertical to the tube axis, represented by the following Formula 1', and a second sagging amount curve representing a second sagging amount Z2' at a point at the distance d' from the reference point in the direction vertical to the tube axis, represented by the following Formula 2', are defined. A sagging amount change curve along a curve C1' on the inner surface of the panel, which a plane passing through a center P0' of a useful area of the panel and parallel to the tube axis and a major axis crosses, satisfies the following Condition 1'. Furthermore, assuming that an intersection between the curve C1' and the useful area end of the inner surface of the panel is a major axis end PL', a distance from the center P0' to the major axis end PL' along the major axis is W', and a point on the curve C1' away from the center P0' by ⅔×W' in a major axis direction is P1', a sagging amount change curve along a curve C2' on the inner surface of the panel, which a plane passing through the point P1' and parallel to the tube axis and a minor axis crosses, satisfies the following Condition 2'.

$$Z1'=\{(Ze'\cdot(1-rf1'))/L'^2\}d'^2+\{(Ze'\cdot rf1')/L'^4\}*d'^4 \qquad \text{Formula 1'}$$

$$Z2'=\{(Ze'\cdot(1-rf2'))/L'^2\}d'^2+\{(Ze'\cdot rf2')/L'^4\}\cdot d'^4 \qquad \text{Formula 2'}$$

Condition 1': Assuming that a sagging amount at the major axis end PL' with respect to the center P0' is ZPL', at least 60% portion of the sagging amount change curve along the curve C1' between the center P0' and the major axis end PL' is present between the first sagging amount curve represented by the Formula 1' and the second sagging amount curve represented by the Formula 2', where L'=W', Ze'=ZPL', rf1'=0.7, rf2'=1.2, Condition 2': Assuming that an intersection between the curve C2' and the useful area end of the inner surface of the panel is P2', a distance from the point P1' to the point P2' in a minor axis direction is H2', and a sagging amount at the point P2' with respect to the point P1' is ZP2', at least 60% portion of the sagging amount change curve along the curve C2' between the point P1' and the point P2' is present between the first sagging amount curve represented by the Formula 1' and the second sagging amount curve represented by the Formula 2', where L'=H2', Ze'=ZP2', rf1'=−0.4, rf2'=0.

These and other advantages of the present invention will become apparent to those skilled in the art upon reading and understanding the following detailed description with reference to the accompanying figures.

DESCRIPTION OF THE PREFERRED EMBODIMENTS

According to the present invention, a color picture tube can be provided having satisfactory visibility and less degradation in color purity caused by doming while having an inexpensive shadow mask.

Hereinafter, the present invention will be described in detail with reference to the drawings.

Embodiment 1

Figure 1:
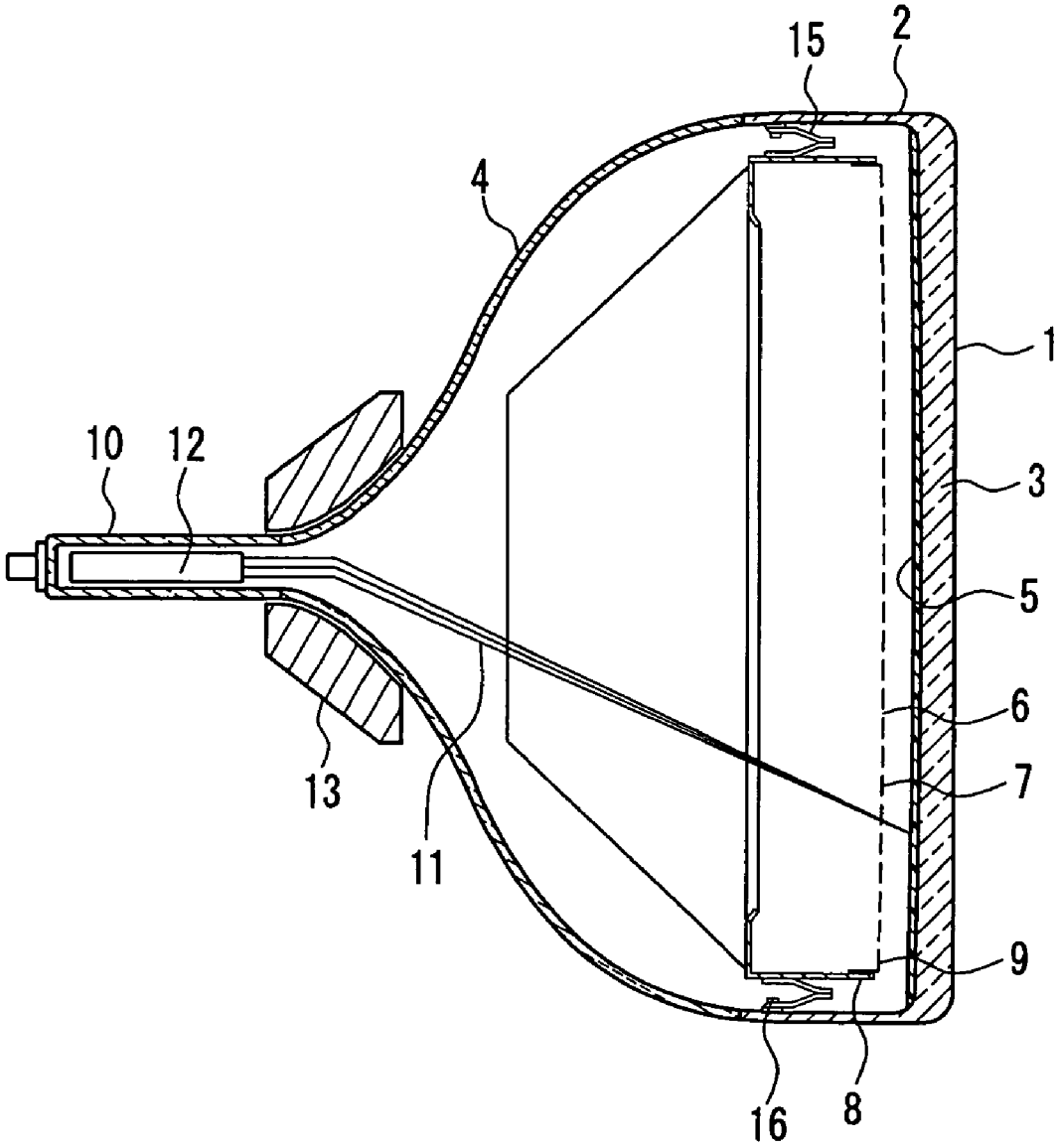
FIG. 1 is a cross-sectional view showing a schematic configuration of a color picture tube.

FIG. 1 is a cross-sectional view of a color picture tube. The color picture tube includes an envelope composed of a substantially rectangular panel 3 in which a skirt portion 2 is provided on the periphery of an useful surface 1 on which an image is displayed, and a funnel 4 in a funnel shape connected to the skirt portion 2. A substantially rectangular shadow mask 7 having a curved surface in which a number of electron beam passage apertures 6 are formed is placed so as to be opposed to a phosphor screen 5 made of three-color phosphor layers formed on an inner surface of the useful surface 1 of the panel 3. The shadow mask 7 is held by a substantially rectangular mask frame 8 having a substantially L-shaped cross-section. A shadow mask structure 9 composed of the shadow mask 7 and the mask frame 8 is supported detachably with respect to the panel 3 with one end of a substantially V-shaped elastic support 15 attached to each corner portion or respectively on a short side and a long side of the mask frame 8, and the other end of the elastic support 15 engaged with a stud pin 16 fixed on an inner wall of the skirt portion 2 of the panel 3. An electron gun 12 emitting three electron beams 11 is housed in a neck 10 of the funnel 4. The three electron beams 11 emitted by the electron gun 12 are deflected by a magnetic field generated by a deflection apparatus 13 mounted on an outer side of the funnel 4, and allowed to scan the phosphor screen 5 in horizontal and vertical directions via the shadow mask 7, thereby displaying a color image.

In order to display an image without any color displacement on the phosphor screen 5 of the color picture tube, the three electron beams 11 passing through the electron beam passage apertures 6 formed in the shadow mask 7 should land correctly on the three-color phosphor layers of the phosphor screen 5 respectively. For this purpose, it is necessary to maintain the correct position between the panel 3 and the shadow mask 7.

Recently, in order to enhance the visibility of the color picture tube, the outer surface of the useful surface 1 of the panel 3 is being substantially flattened with a radius of curvature of 10,000 mm or more, and along with this, the shadow mask 7 also should be flattened.

When the curvature of the shadow mask 7 is decreased, it becomes difficult to form a curved surface by molding. However, by using a material containing 95% or more of iron, the moldability of a curved surface can be improved remarkably at low cost.

However, such a material has a high coefficient of thermal expansion. Therefore, when a local image pattern with high brightness is displayed, local doming occurs, and the landing positional shift of the electron beams becomes large.

As measures for addressing the above-mentioned problem, it is considered to increase the curvature of the shadow mask 7, and also increase the curvature of the inner surface of the panel 3 in accordance with the increased curvature of the shadow mask 7.

However, in this case, owing to the increase in thickness of the periphery of the panel 3, there arise problems such as the cracking of the panel 3 caused by thermal stress in the course of production thereof, the degradation in brightness, and the increase in weight.

The present invention can solve the above-mentioned problems. One example thereof will be described below.

Figure 2:
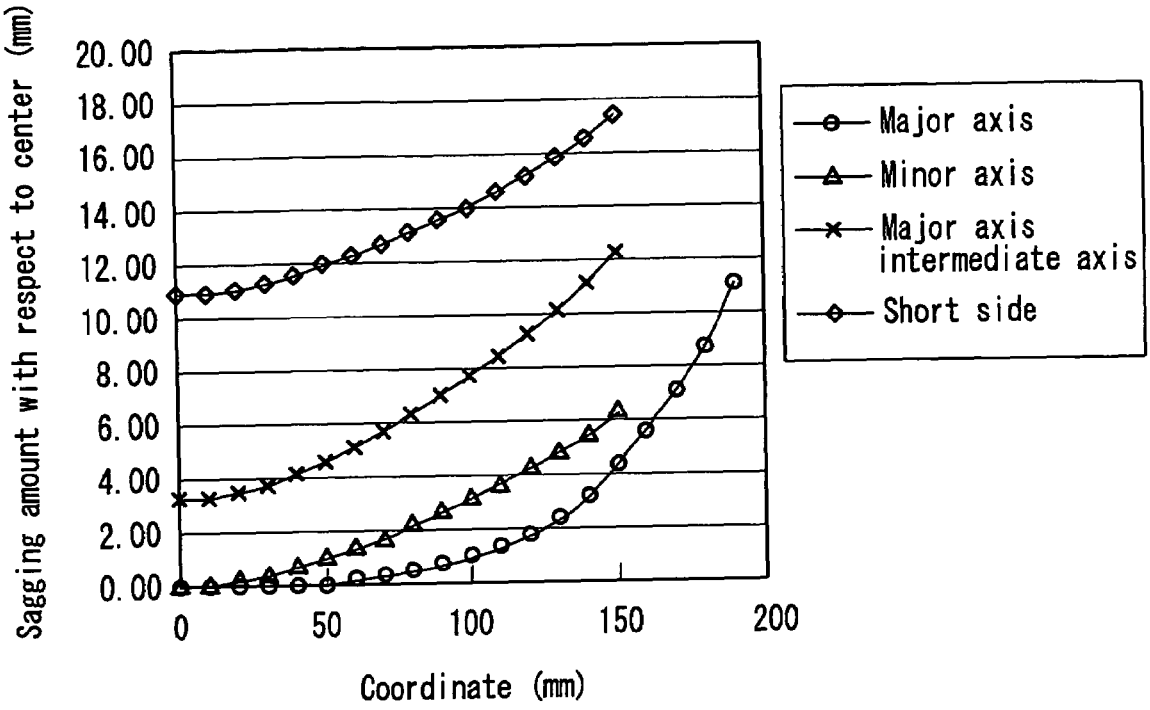
FIG. 2 shows a sagging amount change curve of a shadow mask according to one example for a color picture tube with a diagonal useful size of 51 cm corresponding to Embodiment 1 of the present invention.

FIG. 2 shows the sagging amount of a surface of the shadow mask 7 used for a color picture tube with a diagonal useful size of 51 cm, an aspect ratio of 4:3, and a radius of curvature of an outer surface of the useful surface 1 of the panel 3 of 20,000 mm. Herein, the sagging amount refers to a displacement amount (the side of the electron gun 12 is assumed to be positive) in a tube axis (Z-axis) direction of the surface (surface opposed to the phosphor screen 5) of the shadow mask 7.

Figure 3:
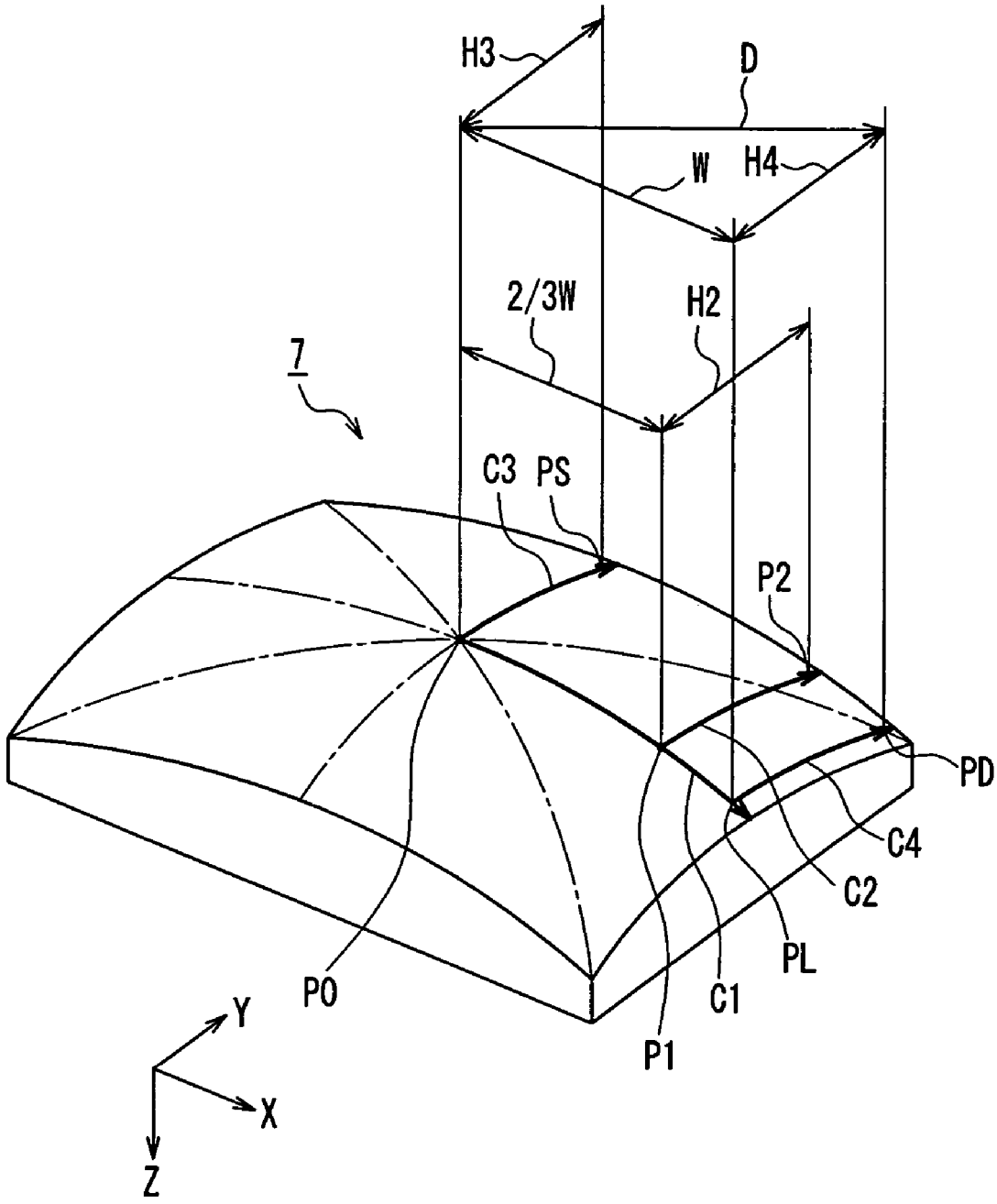
FIG. 3 is a schematic view illustrating curves on a shadow mask, which are given attention, according to the present invention.

As shown in FIG. 3, it is assumed that a center (i.e., a point where the tube axis (Z-axis) crosses) of the substantially rectangular shadow mask 7 is P0, an axis orthogonal to the tube axis and parallel to a long side is a major axis (X-axis), and an axis orthogonal to the tube axis and the major axis and parallel to a short side is a minor axis (Y-axis).

In FIG. 2, a "major axis" represents a sagging amount change curve along a curve C1 on the surface of the shadow mask 7, which a plane passing through the center P0 and parallel to the tube axis and the major axis crosses in FIG. 3. In this case, a position (reference point), at which the "coordinate" of a horizontal axis is 0 in FIG. 2, corresponds to the center P0.

In FIG. 3, assuming that an intersection between the curve C1 and the useful area end of the shadow mask 7 is a major axis end PL, a distance between the center P0 and the major axis end PL along the major axis is W, and a point on the shadow mask 7 (curve C1) away from the center P0 by (⅔)×W in a major axis direction is P1, in FIG. 2, a "major axis intermediate axis" represents a sagging amount change curve along a curve C2 on the surface of the shadow mask 7, which a plane passing through the point P1 and parallel to the tube axis and the minor axis crosses. In this case, a position (reference point), at which the "coordinate" of the horizontal axis is 0 in FIG. 2, corresponds to the point P1. According to the present invention, the "useful area" of the shadow mask 7 refers to an area on the shadow mask 7 in which a number of electron beam passage apertures are formed.

In FIG. 2, a "minor axis" represents a sagging amount change curve along a curve C3 on the surface of the shadow mask 7, which a plane passing through the center P0 and parallel to the tube axis and the minor axis crosses in FIG. 3. In this case, a position (reference point), at which the "coordinate" of the horizontal axis is 0 in FIG. 2, corresponds to the center P0.

In FIG. 2, a "short side" represents a sagging amount change curve along a curve C4 on the surface of the shadow mask 7, which a plane passing through the major axis end PL and parallel to the tube axis and the minor axis crosses in FIG. 3. In this case, a position (reference point), at which the "coordinate" of the horizontal axis is 0 in FIG. 2, corresponds to the major axis end PL.

The vertical axis in FIG. 2 shows a sagging amount with respect to the center P0.

In the present example, the shadow mask 7 has a spline curved surface in which the sagging amount change curves shown in FIG. 2 along the curves C1, C2 satisfy the following conditions.

Assuming that a distance from the reference point to the useful area end on the shadow mask 7 in a direction vertical to the tube axis is L, and a sagging amount at the useful area end with respect to the reference point is Ze, a first sagging amount curve representing a first sagging amount Z1 at a point at a distance d from the reference point in a direction vertical to the tube axis, represented by the following Formula 1, and a second sagging amount curve representing a second sagging amount Z2 at a point at the distance d from the reference point in the direction vertical to the tube axis, represented by the following Formula 2, are defined.

$$Z1=\{(Ze\cdot(1-rf1))/L^2\}d^2+\{(Ze\cdot rf1)/L^4\}\cdot d^4 \quad \text{Formula 1}$$

$$Z2=\{(Ze\cdot(1-rf2))/L^2\}d^2+\{(Ze\cdot rf2)/L^4\}\cdot d^4 \quad \text{Formula 2}$$

The sagging amount change curve shown in FIG. 2 along the curve C1 satisfies the following Condition 1.

Condition 1: As shown in FIG. 3, assuming that a distance from the center P0 to the major axis end PL of the shadow mask 7 along a major axis is W, and a sagging amount at the major axis end PL with respect to the center P0 is ZPL, at least 60% portion of the sagging amount change curve along the curve C1 between the center P0 and the major axis end PL is present between the first sagging amount curve represented by Formula 1 and the second sagging amount curve represented by Formula 2, where L=W. Ze=ZPL, rf1=0.7, rf2=1.2.

The sagging amount change curve shown in FIG. 2 along the curve C2 satisfies the following Condition 2.

Condition 2: As shown in FIG. 3, assuming that an intersection between the curve C2 and the useful area end of the shadow mask 7 is P2; a distance from the point P1 to the point P2 in the minor axis direction is H2, and a sagging amount at the point P2 with respect to the point P1 is ZP2, at least 60% portion of the sagging amount change curve along the curve C2 between the point P1 and the point P2 is present between the first sagging amount curve represented by Formula 1 and the second sagging amount curve represented by Formula 2, where L=H2, Ze=ZP2, rf1=−0.4, rf2=0.

Furthermore, it is preferable that the sagging amount change curve shown in FIG. 2 along the curve C3 satisfies the following Condition 3.

Condition 3: As shown in FIG. 3, assuming that an intersection between the curve C3 and the useful area end of the shadow mask 7 is a minor axis end PS, a distance from the center P0 to the minor axis end PS along a minor axis is H3, and a sagging amount at the minor axis end PS with respect to the center P0 is ZPS, at least 60% portion of the sagging amount change curve along the curve C3 between the center P0 and the minor axis end PS is positioned on a side where a sagging amount is larger with respect to the first sagging amount curve represented by Formula 1, where L=H3, Ze=ZPS, rf1=0.2.

Furthermore, it is preferable that the sagging amount change curve shown in FIG. 2 along the curve C4 satisfies the following Condition 4.

Condition 4: As shown in FIG. 3, assuming that an intersection between the curve C4 and a diagonal line of the shadow mask 7 is a diagonal end PD, a distance from the major axis end PL to the diagonal end PD in the minor axis direction is H4, and a sagging amount at the diagonal end PD with respect to the major axis end PL is ZPD, at least 60% portion of the sagging amount change curve along the curve C4 between the major axis end PL and the diagonal end PD is present between the first sagging amount curve represented by Formula 1 and the second sagging amount curve represented by Formula 2, where L=H4, Ze=ZPD, rf1=−0.4, rf2=0.

Figure 4:
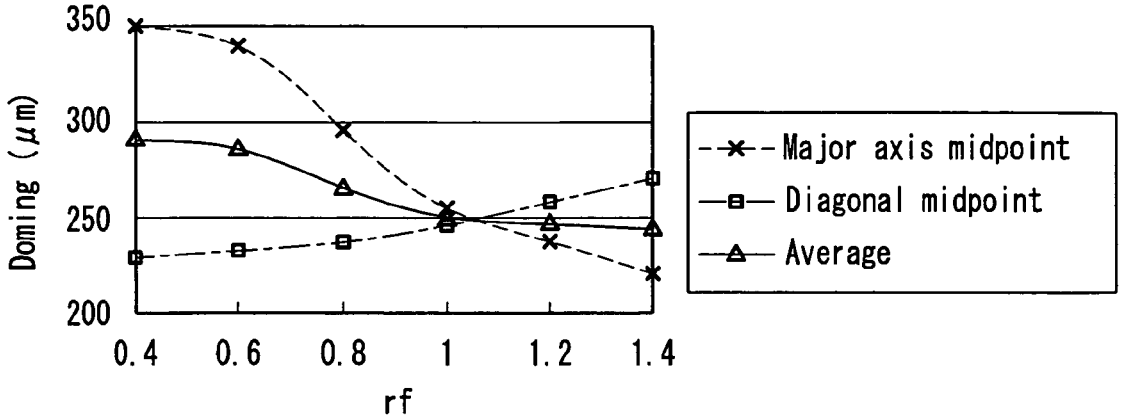
FIG. 4 shows a relationship between the sagging amount change curve along a curve C1 and the doming in the shadow mask according to one example corresponding to Embodiment 1 of the present invention.

FIG. 4 shows a relationship between the sagging amount change curve along the curve C1 and the doming. In the following Formula 5, the sagging amount change curve along the curve C1 is obtained by varying rf, under a condition of setting L=190 mm and Ze=10.87 mm, and a doming amount in each case is obtained.

$$Z=\{(Ze\cdot(1-rf))/L^2\}d^2+\{(Ze\cdot rf)/L^4\}\cdot d^4 \quad \text{Formula 5}$$

In FIG. 4, a "major axis midpoint" represents a doming amount at a midpoint between the center P0 and the major axis end PL, and a "diagonal midpoint" represents a doming amount at a midpoint between the center P0 and the diagonal end PD, and an "average" represents an average value of the doming amounts at both positions. At these positions, the doming amount is likely to become maximum in the shadow mask.

In FIG. 4, when rf is in the vicinity of 1.1, the balance between the doming amounts at both the positions is satisfactory. When rf is more than 1.2, a portion (i.e., an inflection point) in which a curvature is reversed is likely to appear in the sagging amount change curve; consequently, the strength of a shadow mask decreases, and the production thereof becomes difficult. By setting $0.7 \leqq rf \leqq 1.2$ which satisfies the above-mentioned Condition 1, doming can be suppressed while the strength and moldability of the shadow mask are ensured.

Figure 5:
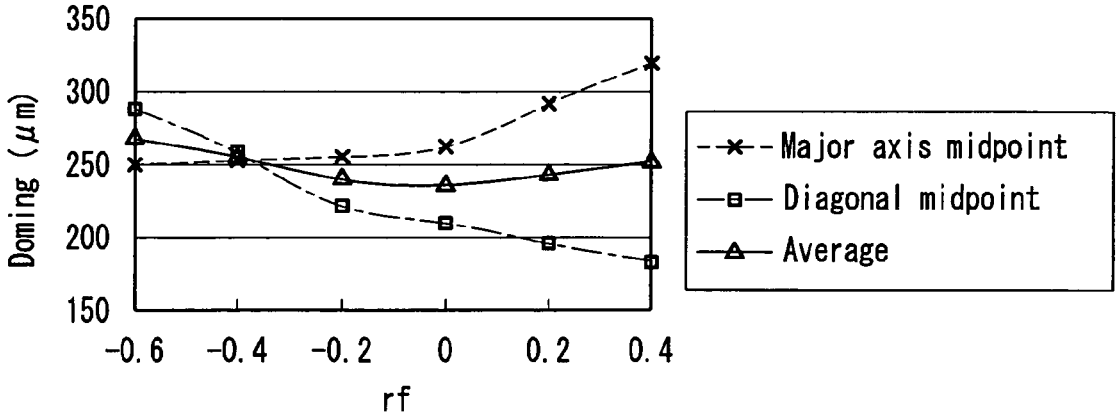
FIG. 5 shows a relationship between the sagging amount change curve along a curve C2 and the doming in the shadow mask according to one example corresponding to Embodiment 1 of the present invention.

FIG. 5 shows a relationship between the sagging amount change curve along the curve C2 and the doming. In the following Formula 5, the sagging amount change curve along the curve C2 is obtained by varying rf, under a condition of setting L=143 mm and Ze=8.21 mm, and a doming amount in each case is obtained.

$$Z=\{(Ze\cdot(1-rf))/L^2\}d^2+\{(Ze\cdot rf)/L^4\}\cdot d^4 \quad \text{Formula 5}$$

In FIG. 5, a "major axis midpoint" represents a doming amount at a midpoint between the center P0 and the major axis end PL, a "diagonal midpoint" represents a doming amount at a midpoint between the center P0 and the diagonal end PD, and an "average" represents an average value of the doming amounts at both the positions. At these positions, the doming amount is likely to become maximum in the shadow mask.

Generally, the sagging amount change curve along the curve C2 has a particularly large influence on doming. In FIG. 5, the following is found: when $-0.4 \leqq rf \leqq 0$ which satisfies the above-mentioned Condition 2, the balance between the doming amounts at both the positions is satisfactory, and the average value thereof is small, so that doming is suppressed effectively.

In FIGS. 4 and 5, although the sagging amount change curves are varied with the same L and Ze as those in the example shown in FIG. 2, the above-mentioned effect generally is obtained irrespective of the values of L and Ze. More specifically, if the sagging amount change curve connecting the reference point to a point (end point) at a distance L from the reference point satisfies the above-mentioned conditions of the present invention, the effect of suppressing doming of the present invention can be obtained.

Table 1 shows a maximum value of an electron beam movement amount on a screen caused by doming, when rf is varied in three ways in the sagging amount change curves obtained by the above-mentioned Formula 5 along the curves C1 and C2. As the values of L and Ze, the same values as those in FIGS. 4 and 5 are used.

TABLE 1

| | rf | Maximum movement amount of electron beam caused by doming (μm) |
|---|---|---|
| Sagging amount | 0.4 | 350 |
| change curve along | 1.0 (present invention) | 255 |
| curve C1 | 1.4 | 270 |
| Sagging amount | −0.6 | 287 |
| change curve along | −0.2 (present invention) | 255 |
| curve C2 | 0.4 | 320 |

It is understood that the movement amount of electron beams can be reduced in the case where the above-mentioned Conditions 1 and 2 are satisfied. Thus, doming is largely influenced by the sagging amount change curves along the curves C1 and C2.

Furthermore, it is preferable that the sagging amount change curve along the curve C3 satisfies the above-mentioned Condition 3, since the following effect can be obtained. First, the problem of doming in an area slightly closer to the center P0 with respect to the point P1 can be solved. Second, the curved surface holding strength (strength capable of holding a curved surface shape with respect to an external force) of the shadow mask 7 can be enhanced. For example, in a shadow mask in which the sagging amount change curve along the curve C3 is represented by the above-mentioned Formula 5 where rf=0, the curved surface holding strength is enhanced by about 35%, compared with that of the shadow mask represented by the above-mentioned Formula 5 where rf=0.6.

Furthermore, when the sagging amount change curve along the curve C4 satisfies the above-mentioned Condition 4, the following effect is obtained. First, the problem of doming in an area slightly close to an outer side with respect to the point P1 can be solved. Second, the curvature of the sagging amount change curve can be prevented from being reversed (i.e., the sagging amount change curve can be prevented from having an inflection point). Third, a screen shape without any sense of incongruity is obtained.

Table 2 shows a summary of electron beam movement amounts caused by doming at the point P1 in the case where a shadow mask has various kinds of surface shapes in color picture tubes with three types of screen diagonal useful sizes. In Table 2, a "single radius of curvature" represents the case where the shadow mask has a shape with a part of a spherical surface having a radius of curvature R cut away. A "cylindrical surface in a minor axis direction" represents the case where a shadow mask has a cylindrical surface shape in which the radius of curvature in the minor axis direction is constant irrespective of a position in the major axis direction as shown in the above-mentioned JP 10(1998)-199436 A. A "spline approximation" represents the case where the surface shape of a useful area of a shadow mask is composed of a spline approximated curved surface of x and y, where x represents a major axis direction and y represents a minor axis direction. A "biquadratic function approximation" represents the case where the surface shape of a useful area of a shadow mask is composed of a biquadratic function approximated curved surface of x and y, where x represents a major axis direction and y represents a minor axis direction. The above-mentioned Conditions 1 to 4 of the present invention are satisfied in the "spline approximation" and the "biquadratic function approximation". For ease of comparison, the sagging amount at a diagonal end is set to be the same at the same screen diagonal useful size.

Figure 6:
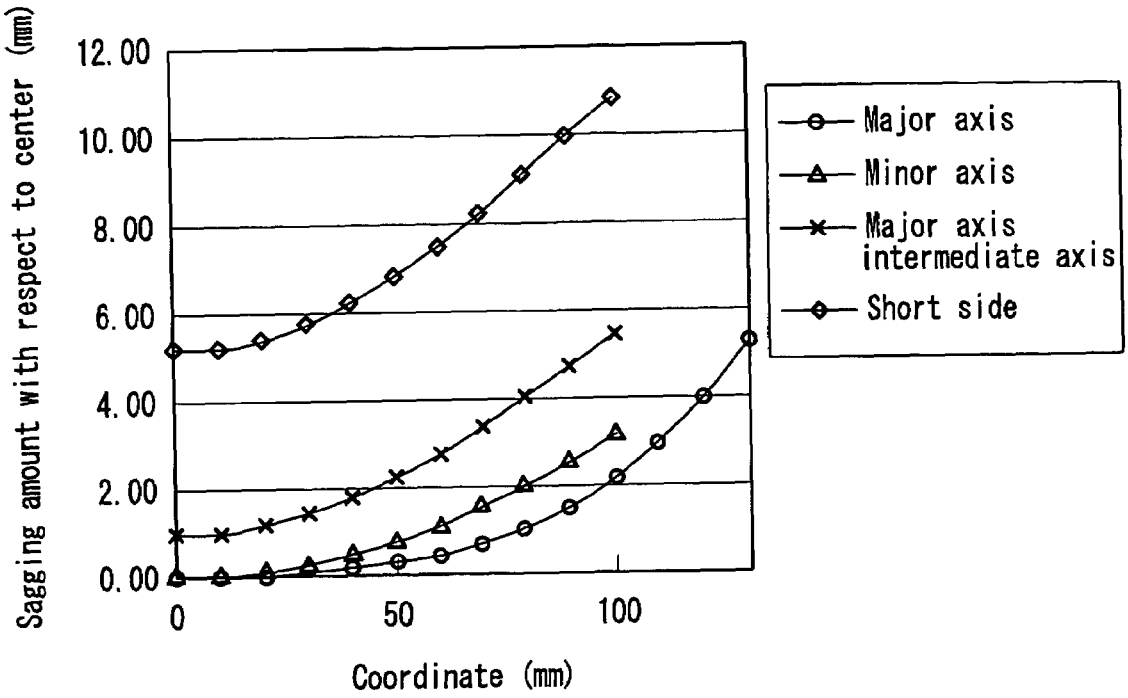
FIG. 6 shows a sagging amount change curve of the shadow mask according to one example for a color picture tube with a diagonal useful size of 36 cm corresponding to Embodiment 1 of the present invention.
Figure 7:
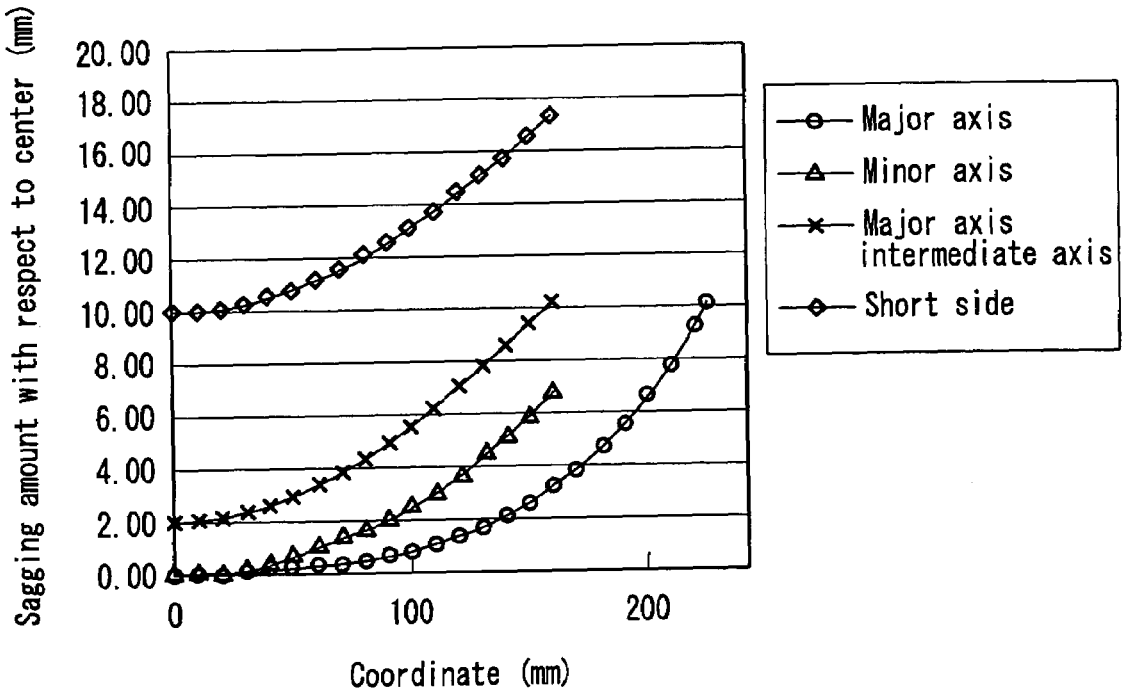
FIG. 7 shows a sagging amount change curve of a shadow mask according to one example for a color picture tube with a diagonal useful size of 60 cm corresponding to Embodiment 1 of the present invention.

The sagging amount change curves along the curves C1 to C4 of a shadow mask of the "spline approximation" with a diagonal useful size of 51 cm are as shown in FIG. 2. FIG. 6 shows sagging amount change curves along the curves C1 to C4 of a shadow mask of the "spline approximation" with a diagonal useful size of 36 cm, and FIG. 7 shows sagging amount change curves along the curves C1 to C4 of a shadow mask of the "spline approximation" with a diagonal useful size of 60 cm.

FIG. 6 shows a sagging amount of a shadow mask surface according to one example of the present invention having a spline approximated curved surface, used in a color picture tube with a diagonal useful size of 36 cm, an aspect ratio of 4:3, and a radius of curvature of an outer surface of the useful surface 1 of the panel 3 of 20,000 mm, in the same way as in FIG. 2. Furthermore, FIG. 7 shows a sagging amount of a shadow mask surface according to one example of the present invention having a spline approximated curved surface, used in a color picture tube with a diagonal useful size of 60 cm, an aspect ratio of 4:3, and a radius of curvature of an outer surface of the useful surface 1 of the panel 3 of 20,000 mm, in the same way as in FIG. 2.

According to the present invention, irrespective of the sagging amount at a diagonal end, the effect of suppressing doming can be obtained. Thus, for example, if a panel has a diagonal useful size of 51 cm, the effect of suppressing doming is obtained with the same panel weight as that (9.5 kg) in the case of using an expensive Invar material.

The doming occurring in the vicinity of the center of a screen of the shadow mask is almost negligible, since it is unlikely to influence the movement of the landing position of electron beams. According to the present invention, the doming in the vicinity of the center of the screen, which is negligible, is set to be relatively larger than that in the vicinity of the point P1 where the allowable range is narrowest. This can suppress the doming in the vicinity of the point P1.

Figure 8:
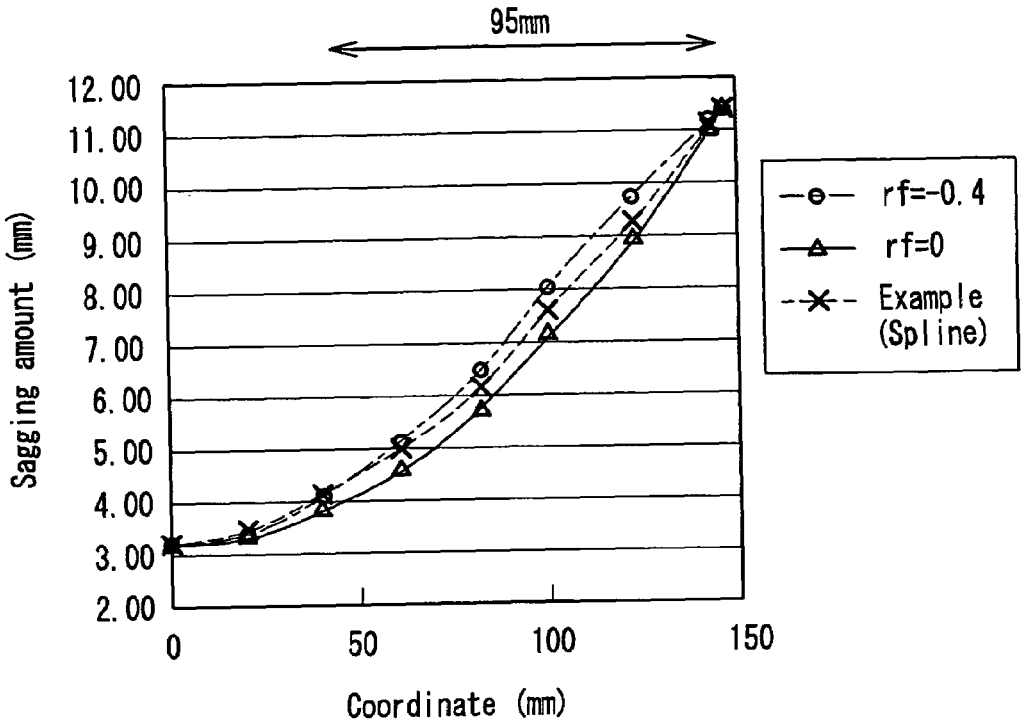
FIG. 8 shows a relationship between the sagging amount change curve along the curve C2 and Condition 2 of the present invention, in one example of a shadow mask for a color picture tube with a diagonal useful size of 51 cm corresponding to Embodiment 1 of the present invention.

FIG. 8 shows a relationship between the sagging amount change curve ("major axis intermediate axis") along the curve C2 of the shadow mask shown in FIG. 2 and Condition 2 of the present invention. A broken line represents the sagging amount change curve of the present example, "rf=−0.4"represents a first sagging amount curve represented by Formula 1 under Condition 2, and "rf=0" represents a second sagging amount curve represented by Formula 2 under Condition 2. The sagging amount change curve of the present example represented by the broken line extends over a distance H2=143 mm from the point P1 to the point P2 in a direction parallel to the minor axis, and a portion of 95 mm corresponding to 66% of the distance is positioned between the first sagging amount curve and the second sagging amount curve. It is most preferable that all the portions of the sagging amount change curve are present between the first sagging amount curve and the second sagging amount curve. However, as long as at least 60% of the sagging amount change curve is positioned between the first sagging amount curve and the second sagging amount curve, the effect of suppressing doming can be obtained.

TABLE 2

| Diagonal useful size (cm) | Surface shape | Movement amount of electron beam (μm) | Sagging amount at diagonal end (mm) |
|---|---|---|---|
| 51 | Single radius of curvature (R = 1694 mm) | 443 | 16.8 |
| | Cylindrical surface in minor axis direction | 281 | 16.8 |
| | Spline approximation (present invention) | 256 | 16.8 |
| | Biquadratic function approximation (present invention) | 255 | 16.8 |
| 36 | Single radius of curvature (R = 1207 mm) | 310 | 12.0 |
| | Spline approximation (present invention) | 243 | 12.0 |
| 60 | Single radius of curvature (R = 2209 mm) | 578 | 18.0 |
| | Spline approximation (present invention) | 330 | 18.0 |

According to Table 2, it is understood that irrespective of a screen size, in the case where Conditions 1 to 4 of the present invention are satisfied, the movement amount of electron beams caused by doming can be reduced largely. In the case of the "cylindrical surface in a minor axis direction", although the movement amount of electron beams can be reduced to some degree, when a panel with a substantially flat outer surface corresponding to such a shadow mask is produced, it is necessary to increase the thickness of the panel at a minor axis end (about 10 mm). Consequently, the weight of the panel increases greatly, leading to an increase in cost. Furthermore, the difference in thickness between the center and the minor axis end of the panel increases, so that panel cracking caused by thermal distortion during a heating process in the course of production of a color picture tube increases. According to the present invention, doming can be suppressed largely while the weight of a panel is kept equal to that in the case of the "single radius of curvature".

Figure 9:
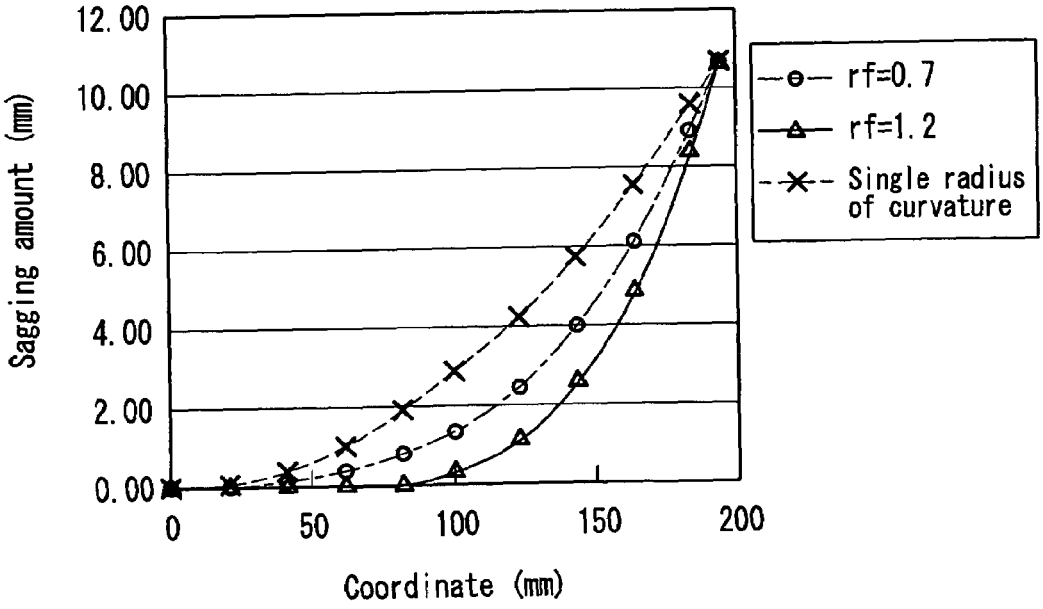
FIG. 9 shows a relationship between the sagging amount change curve along the curve C1 of a shadow mask having a single radius of curvature and Condition 1 of the present invention.

FIG. 9 shows a relationship between the sagging amount change curve along the curve C1 of the shadow mask having a single radius of curvature with a diagonal useful size of 51 cm, shown in Table 2 and Condition 1 of the present invention. A broken line represents the sagging amount change curve along the curve C1 of the shadow mask, "rf=0.7" represents a first sagging amount curve represented by Formula 1 under Condition 1, and "rf=1.2" represents a second sagging amount curve represented by Formula 2 under Condition 1. In this example, none of the portions of the sagging amount change curve along the curve C1 between the center P0 and the major axis end PL is present between the first sagging amount curve and the second sagging amount curve.

As shown in FIG. 3, assuming that a distance from the center P0 to the useful area end of the shadow mask 7 is D on a diagonal axis, W on the major axis, and H3 on the minor axis, and the sagging amount with respect to the center P0 is $Z_{MD}$ at the diagonal end of the useful area, $Z_{MH}$ at the major axis end, and $Z_{MV}$ at the minor axis end, it is preferable to satisfy the following Formulas 3 and 4:

$$Z_{MD}>1.4\times Z_{MH}>Z_{MV} \quad \text{Formula 3}$$

$$Z_{MD}/D>0.06 \quad \text{Formula 4}$$

Formula 3 defines the sagging amount $Z_{MH}$ at the major axis end. When the sagging amount $Z_{MH}$ at the major axis end is increased too much, doming characteristics are degraded. The appropriate effect of suppressing doming can be obtained by satisfying Formula 3.

Formula 4 defines a degree of sagging at the diagonal end. As $Z_{MD}$/D is larger, the curvature along the curve C2 most largely influencing doming becomes larger, so that the large effect of suppressing doming is obtained. When $Z_{MD}$/D is increased too much as in Embodiment 2 described later, the thickness of the screen useful area of the panel at the diagonal end also tends to increase. Thus, it is preferable to set $Z_{MD}$/D to be large within the allowable upper limit of the thickness of the panel.

In the above-mentioned shadow mask in FIG. 2, $Z_{MD}$/D=0.071, $Z_{MD}$=16.8 mm, $Z_{MV}$=5.9 mm, and $Z_{MH}$=10.9 mm.

As described above, according to the present embodiment, the outer surface of the useful surface 1 of the panel 3 is flattened sufficiently as described above, and satisfactory visibility is obtained. Furthermore, as a material for the shadow mask 7, it is possible to use, for example, aluminum killed steel shown in Table 3 made of high-purity iron with a coefficient of thermal expansion of $12\times10^{-6}$ at 0° C. to 100° C. Therefore, the moldability of the shadow mask 7 is satisfactory while entailing low cost. Then, doming can be suppressed as described above, so that a color picture tube with less degradation in color purity caused by doming can be provided.

TABLE 3

| Component | Aluminum killed steel | Invar alloy |
|---|---|---|
| C | 0.002 | 0.009 |
| Mn | 0.3 | 0.47 |
| Si | <0.01 | 0.13 |
| P | 0.016 | 0.005 |
| S | 0.009 | 0.002 |
| Al | 0.052 | — |
| Ni(+Co) | — | 36.5 |
| Fe | Remaining portion | Remaining portion |

(Unit: %)

The surface of the useful area of the shadow mask 7 may be coated with bismuth oxide, whereby doming can be suppressed further.

Embodiment 2

In a color picture tube, it is preferable that the interval q between the panel 3 and the shadow mask 7 is set appropriately over an entire range of a screen. Therefore, it is preferable that the inner surface of the panel 3 has a curvature close to that of the curved surface of the shadow mask 7. In the case where the shadow mask 7 is made of a material containing 95% or more of iron, and the surface thereof is set in a shape effective for suppressing doming, as described in Embodiment 1, it is preferable that the inner surface of the panel 3 satisfies the conditions similar to those in Embodiment 1. The reason for this is as follows.

Figure 10:
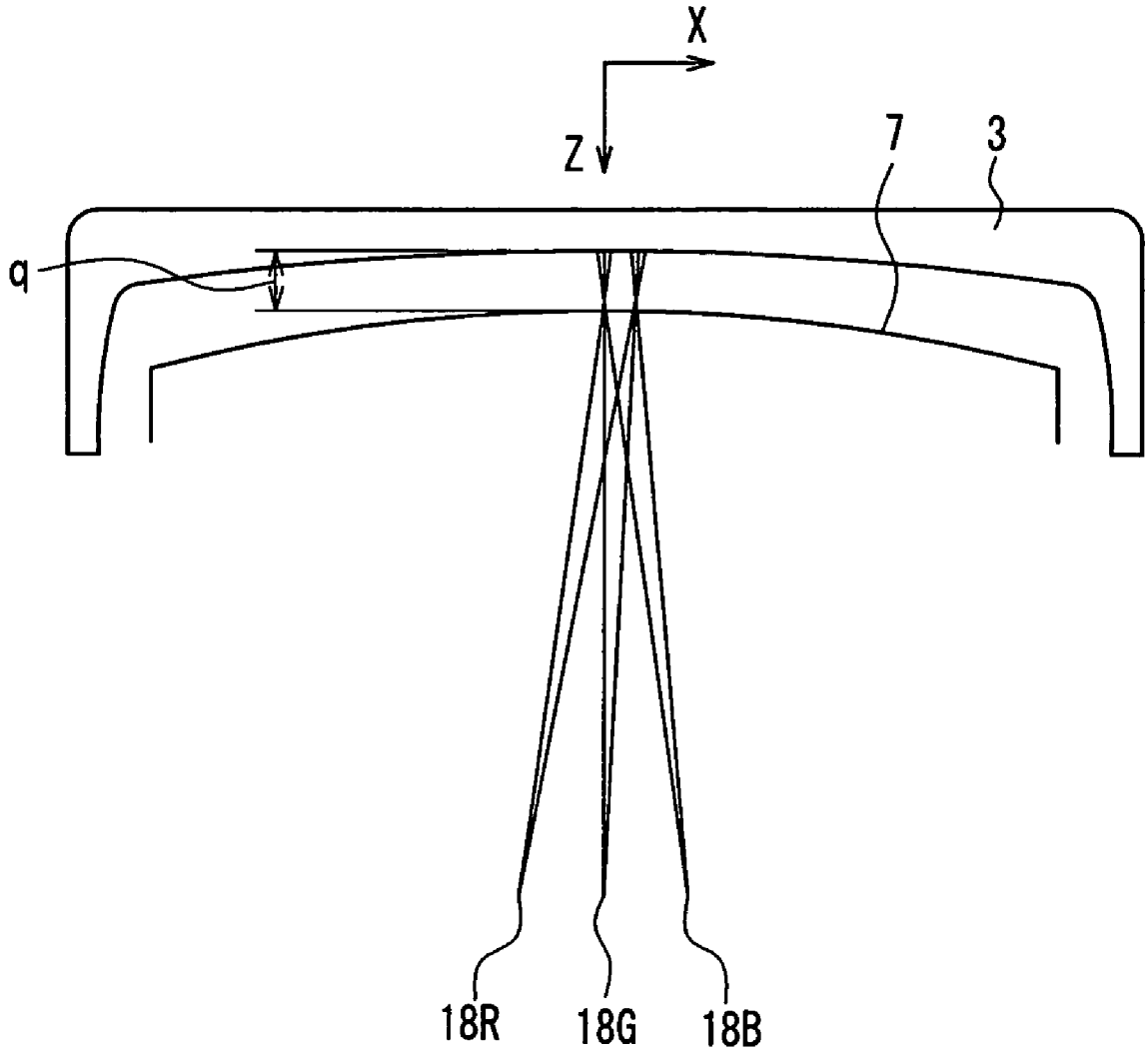
FIG. 10 is a schematic view showing a method for forming a phosphor stripe.

The phosphor screen 5 is formed by a light-exposure method using the shadow mask 7 as a mask. More specifically, as shown in FIG. 10, phosphor stripes of three colors (red, green, and blue) are obtained by irradiating the inner surface of the panel 3 with light beams from light sources 18R, 18G, and 18B of a light-exposure apparatus, approximated to paths of electron beams.

Figure 11A:
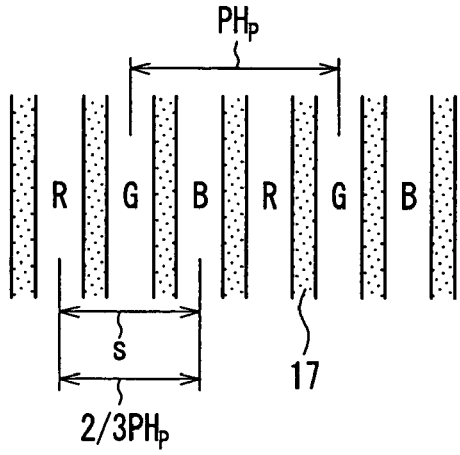
FIG. 11A is an enlarged front view of an ideal phosphor screen.
Figure 11B:
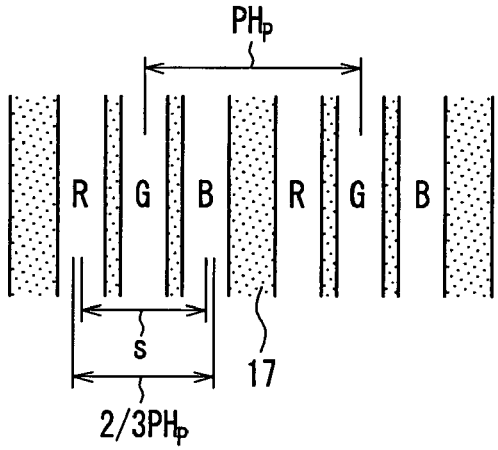
FIGS. 11B and 11C are enlarged front views of inappropriate phosphor screens.
Figure 11C:
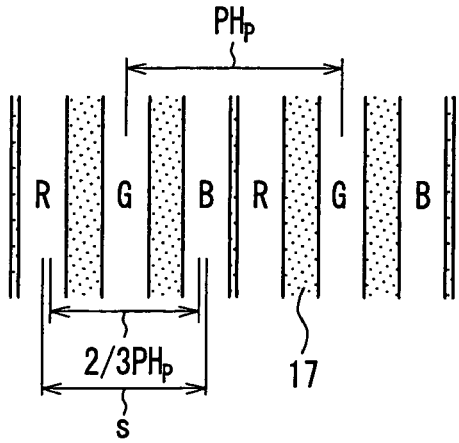

At this time, the above-mentioned interval q is set so as to satisfy s=⅔ $PH_P$ as shown in FIG. 11A, whereby uniform phosphor stripes are obtained. Herein, $PH_P$ represents an arrangement pitch of phosphor stripes of three colors (red R, green G, and blue B), and is determined uniquely by the arrangement pitch of electron beam passage apertures of the shadow mask. In the above expression, s represents an interval between the center of the red phosphor stripe R and the center of the blue phosphor stripe B, and varies depending upon the interval q. However, when s<⅔ $PH_P$ as shown in FIG. 11B, or s>⅔ $PH_P$ as shown in FIG. 11C, the width of each black non-light-emitting layer (black stripe) 17 cannot be obtained sufficiently. Thus, the color purity during an operation of the color picture tube is likely to degrade. As the pitch $PH_P$ is larger, the width of the black non-light-emitting layer 17 can be obtained more sufficiently. However, when the pitch $PH_P$ is too large, the resolution degrades.

The inner surface of the panel of the color picture tube according to the present embodiment is configured as follows.

More specifically, assuming that a distance from the reference point to the useful area end on the inner surface of the panel 3 in a direction vertical to the tube axis is L', and a sagging amount at the useful area end with respect to the reference point is Ze', a first sagging amount curve representing a first sagging amount Z1' at a point at a distance d' from the reference point in a direction vertical to the tube axis, represented by the following Formula 1', and a second sagging amount curve representing a second sagging amount Z2' at a point at the distance d' from the reference point in the direction vertical to the tube axis, represented by the following Formula 2', are defined.

$$Z1'=\{(Ze'\cdot(1-rf1'))/L'^2\}d'^2+\{(Ze'\cdot rf1')/L'^4\}\cdot d'^4 \quad \text{Formula 1'}$$

$$Z2'=\{(Ze'\cdot(1-rf2'))/L'^2\}d'^2+\{(Ze'\cdot rf2')/L'^4\}\cdot d'^4 \quad \text{Formula 2'}$$

In the same way as in FIG. 3, it is assumed that a center (i.e., a point where the tube axis (Z-axis) crosses) of a substantially rectangular useful area of the inner surface of the panel 3 is P0', an axis orthogonal to the tube axis and parallel to a long side is a major axis (X-axis), and an axis orthogonal to the tube axis and the major axis and parallel to a short side is a minor axis (Y-axis).

A curve C1' is defined, which is obtained when a plane passing through the center P0' and parallel to the tube axis and the major axis crosses the inner surface of the panel 3.

Assuming that an intersection between the curve C1' and the useful area end of the inner surface of the panel 3 is a major axis end PL', a distance from the center P0' to the major axis end PL' along the major axis is W', and a point on the inner surface (curve C1') of the panel 3 away from the center P0' by (2/3)×W' in the major axis direction is P1', a curve C2' is defined, which is obtained when a plane passing through the point P1' and parallel to the tube axis and the minor axis crosses the inner surface of the panel 3.

A curve C3' is defined, which is obtained when a plane passing through the center P0' and parallel to the tube axis and the minor axis crosses the inner surface of the panel 3.

A curve C4' is defined, which is obtained when a plane passing through the major axis end PL' and parallel to the tube axis and the minor axis crosses the inner surface of the panel 3.

The sagging amount change curve along the curve C1' satisfies the following Condition 1'.

Condition 1': Assuming that a sagging amount at the major axis end PL' with respect to the center P0' is ZPL', at least 60% portion of the sagging amount change curve along the curve C1' between the center P0' and the major axis end PL' is present between the first sagging amount curve represented by Formula 1' and the second sagging amount curve represented by Formula 2', where L'=W', Ze'=ZPL', rf1'=0.7, rf2'=1.2.

The sagging amount change curve along the curve C2' satisfies the following Condition 2'.

Condition 2': Assuming that an intersection between the curve C2' and the useful area end of the inner surface of the panel 3 is P2', a distance from the point P1' to the point P2' in the minor axis direction is H2', and a sagging amount at the point P2' with respect to the point P1' is ZP2', at least 60% portion of the sagging amount change curve along the curve C2' between the point P1' and the point P2' is present between the first sagging amount curve represented by Formula 1' and the second sagging amount curve represented by Formula 2', where L'=H2', Ze'=ZP2', rf1'=−0.4, rf2'=0.

By satisfying Conditions 1' and 2', in the case of forming the phosphor screen 5 by the light-exposure method in the color picture tube provided with the shadow mask 7 shown in Embodiment 1, the black non-light-emitting layers 17 with a uniform width can be formed.

Furthermore, it is preferable that the sagging amount change curve along the curve C3' satisfies the following Condition 3'.

Condition 3': Assuming that an intersection between the curve C3' and the useful area end of the inner surface of the panel 3 is a minor axis end PS', a distance from the center P0' to the minor axis end PS' along a minor axis is H3', and a sagging amount at the minor axis end PS' with respect to the center P0' is ZPS', at least 60% portion of the sagging amount change curve along the curve C3' between the center P0' and the minor axis end PS' is positioned on a side where a sagging amount is larger with respect to the first sagging amount curve represented by Formula 1', where L'=H3', Ze'=ZPS', rf1'=0.2.

By satisfying Condition 3', even in the case where doming occurs, an electron beam is unlikely to land on a phosphor other than the desired phosphor, which prevents the degradation in color purity.

Furthermore, it is preferable that the sagging amount change curve along the curve C4' satisfies the following Condition 4'.

Condition 4': Assuming that an intersection between the curve C4' and the diagonal line of the inner surface of the panel 3 is a diagonal end PD', a distance from the major axis end PL' to the diagonal end PD' in a minor axis direction is H4', and a sagging amount at the diagonal end PD' with respect to the major axis end PL' is ZPD', at least 60% portion of the sagging amount change curve along the curve C4' between the major axis end PL' and the diagonal end PD' is present between the first sagging amount curve represented by Formula 1' and the second sagging amount curve represented by Formula 2', where L'=H4', Ze'=ZPD', rf1'=−0.4, rf2'=0.

By satisfying Condition 4', the sense of incongruity with respect to the shape of the image display surface of the panel is alleviated.

In the present invention, the "useful area" of the inner surface of the panel 3 refers to an area on the inner surface of the panel 3 where phosphor layers of three colors (red, green, and blue) are formed.

Figure 12:
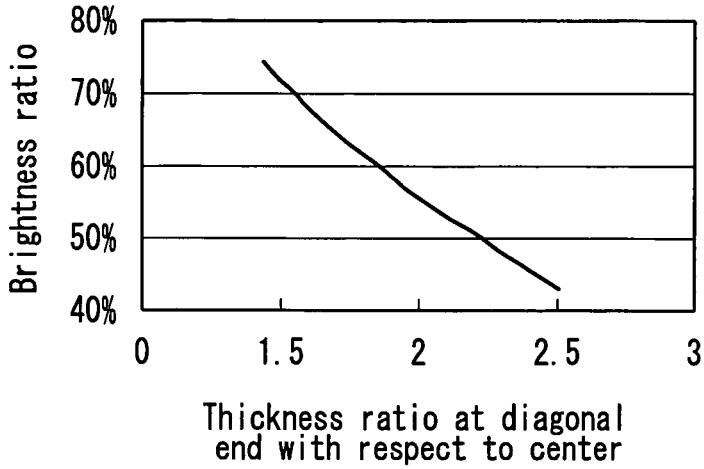
FIG. 12 shows a relationship between the thickness and the brightness at a diagonal end of a panel in Embodiment 2 of the present invention.
Figure 13:
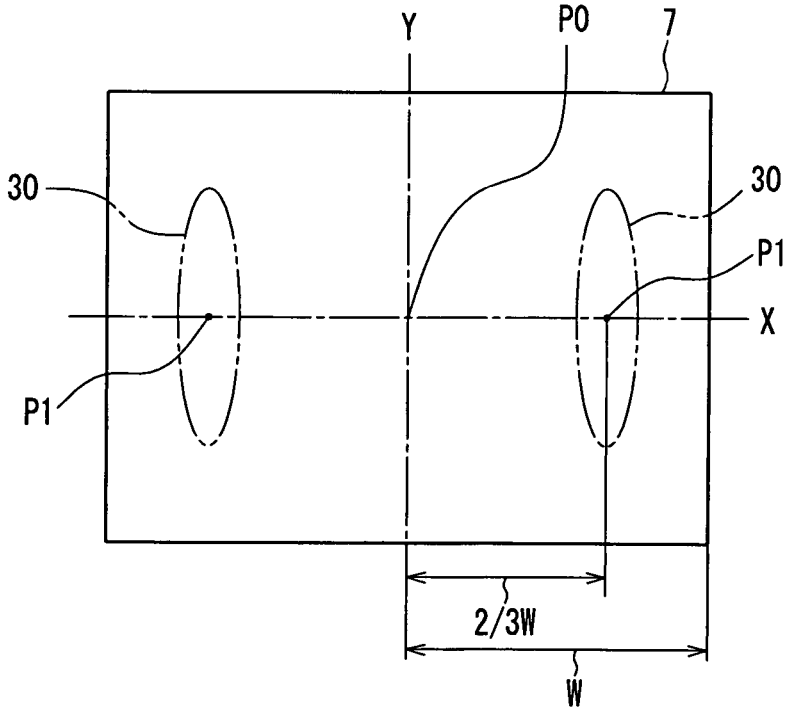
FIG. 13 PRIOR ART
FIG. 13 is a front view of a useful area of a shadow mask showing one example of a position where local doming occurs.

FIG. 12 shows a relationship between the thickness ratio at the diagonal end PD' of the panel 3 with respect to the center P0', and the brightness ratio at the diagonal end PD' at that thickness ratio with respect to the center P0'. As is understood from FIG. 12, as the thickness ratio at the diagonal end PD' increases, the peripheral brightness of the screen decreases. Assuming that a thickness of the panel 1 at the center P0' is $T_C$, and a thickness of the panel 1 at the diagonal end PD' is $T_D$, it is preferable that $T_D/T_C<2.1$. Consequently, by setting the transmittance of the panel 3 at the center P0' to be 40 to 60%, the degradation in brightness on the periphery can be made negligible in spite of a high contrast. In a color picture tube provided with the shadow mask shown in FIG. 2 of Embodiment 1, $T_D/T_C=1.9$.

The applicable field of the present invention is not particularly limited, and the present invention can be applied widely to a color picture tube for a TV, a computer display, etc.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube, comprising:

a panel;

a phosphor screen in a substantially rectangular shape, formed on an inner surface of the panel; and a shadow mask in which a number of electron beam passage apertures are formed, placed so as to be opposed to the phosphor screen, wherein a radius of curvature of an outer surface of the panel is 10,000 mm or more, the shadow mask is made of a material containing 95% or more of iron, assuming that a distance from a reference point to a useful area end on the shadow mask in a direction vertical to a tube axis is L, and a sagging amount at the useful area end with respect to the reference point in a tube axis direction is Ze, in a case of defining a first sagging amount curve representing a first sagging amount Z1 at a point at a distance d from the reference point in the direction vertical to the tube axis, represented by the following Formula 1, and a second sagging amount curve representing a second sagging amount Z2 at a point at the distance d from the reference point in the direction vertical to the tube axis, represented by the following Formula 2, a sagging amount change curve along a curve C1 on a surface of the shadow mask, which a plane passing through a center P0 of a useful area of the shadow mask and parallel to the tube axis and a major axis crosses, satisfies the following Condition 1, and assuming that an intersection between the curve C1 and the useful area end of the shadow mask is a major axis end PL, a distance from the center P0 to the major axis end PL along the major axis is W, and a point on the curve C1 away from the center P0 by ⅔×W in a major axis direction is P1, a sagging amount change curve along a curve C2 on the surface of the shadow mask, which a plane passing through the point P1 and parallel to the tube axis and a minor axis crosses, satisfies the following Condition 2:

$$Z1=\{(Ze\cdot(1-rf1))/L^2\}d^2+\{(Ze\cdot rf1)/L^4\}\cdot d^4 \quad \text{Formula 1:}$$

$$Z2=\{(Ze\cdot(1-rf2))/L^2\}d^2+\{(Ze\cdot rf2)/L^4\}\cdot d^4 \quad \text{Formula 2:}$$

Condition 1: Assuming that a sagging amount at the major axis end PL with respect to the center P0 is ZPL, at least 60% portion of the sagging amount change curve along the curve C1 between the center P0 and the major axis end PL is present between the first sagging amount curve represented by the Formula 1 and the second sagging amount curve represented by the Formula 2, where L=W, Ze=ZPL, rf1=0.7, rf2=1.2, Condition 2: Assuming that an intersection between the curve C2 and the useful area end of the shadow mask is P2, a distance from the point P1 to the point P2 in a minor axis direction is H2, and a sagging amount at the point P2 with respect to the point P1 is ZP2, at least 60% portion of the sagging amount change curve along the curve C2 between the point P1 and the point P2 is present between the first sagging amount curve represented by the Formula 1 and the second sagging amount curve represented by the Formula 2, where L=H2, Ze=ZP2, rf1=−0.4, rf2=0.

2. The color picture tube according to claim 1, wherein a sagging amount change curve along a curve C3 on the surface of the shadow mask, which a plane passing through the center P0 of the shadow mask and parallel to the tube axis and the minor axis crosses, satisfies the following Condition 3, and a sagging amount change curve along a curve C4 on the surface of the shadow mask, which a plane passing through the major axis end PL and parallel to the tube axis and the minor axis crosses, satisfies the following Condition 4:

Condition 3: Assuming that an intersection between the curve C3 and the useful area end of the shadow mask is a minor axis end PS, a distance from the center P0 to the minor axis end PS along the minor axis is H3, and a sagging amount at the minor axis end PS with respect to the center P0 is ZPS, at least 60% portion of the sagging amount change curve along the curve C3 between the center P0 and the minor axis end PS is positioned on a side where a sagging amount is larger with respect to the first sagging amount curve represented by the Formula 1, where L=H3, Ze=ZPS, rf1=0.2, Condition 4: Assuming that an intersection between the curve C4 and a diagonal line of the shadow mask is a diagonal end PD, a distance from the major axis end PL to the diagonal end PD in the minor axis direction is H4, and a sagging amount at the diagonal end PD with respect to the major axis end PL is ZPD, at least 60% portion of the sagging amount change curve along the curve C4 between the major axis end PL and the diagonal end PD is present between the first sagging amount curve represented by the Formula 1 and the second sagging amount curve represented by the Formula 2, where L=H4, Ze=ZPD, rf1=−0.4, rf2=0.

3. The color picture tube according to claim 1, wherein, assuming that a distance from the center P0 to the useful area end of the shadow mask is D on a diagonal axis, W on the major axis, and H3 on the minor axis, and a sagging amount with respect to the center P0 is $Z_{MD}$ at a diagonal end of the useful area, $Z_{MH}$ at the major axis end, and $Z_{MV}$ at a minor axis end, the following Formulas 3 and 4 are satisfied:

$$Z_{MD}>1.4\times Z_{MH}>Z_{MV} \quad \text{Formula 3:}$$

$$Z_{MD}/D>0.06 \quad \text{Formula 4.}$$

4. A color picture tube, comprising:

a panel;

a phosphor screen in a substantially rectangular shape, formed on an inner surface of the panel; and a shadow mask in which a number of electron beam passage apertures are formed, placed so as to be opposed to the phosphor screen, wherein a radius of curvature of an outer surface of the panel is 10,000 mm or more, the shadow mask is made of a material containing 95% or more of iron, assuming that a distance from a reference point to a useful area end on the inner surface of the panel in a direction vertical to a tube axis is L', and a sagging amount at the useful area end with respect to the reference point in a tube axis direction is Ze', in a case of defining a first sagging amount curve representing a first sagging amount Z1' at a point at a distance d' from the reference point in the direction vertical to the tube axis, represented by the following Formula 1', and a second sagging amount curve representing a second sagging amount Z2' at a point at the distance d' from the reference point in the direction vertical to the tube axis, represented by the following Formula 2', a sagging amount change curve along a curve C1' on the inner surface of the panel, which a plane passing through a center P0' of a useful area of the panel and parallel to the tube axis and a major axis crosses, satisfies the following Condition 1', and assuming that an intersection between the curve C1' and the useful area end of the inner surface of the panel is a major axis end PL', a distance from the center P0' to the major axis end PL' along the major axis is W', and a point on the curve C1' away from the center P0' by ⅔×W' in a major axis direction is P1', a sagging amount change curve along a curve C2' on the inner surface of the panel, which a plane passing through the point P1' and parallel to the tube axis and a minor axis crosses, satisfy the following Conditions 2':

$$Z1'=\{(Ze'\cdot(1-rf1'))/L'^2\}d'^2+\{(Ze'\cdot rf1')/L'^4\}\cdot d'^4 \quad \text{Formula 1':}$$

$$Z2'=\{(Ze'\cdot(1-rf2'))/L'^2\}d'^2+\{(Ze'\cdot rf2')/L'^4\}\cdot d'^4 \quad \text{Formula 2':}$$

Condition 1': Assuming that a sagging amount at the major axis end PL' with respect to the center P0' is ZPL', at least 60% portion of the sagging amount change curve along the curve C1' between the center P0' and the major axis end PL' is present between the first sagging amount curve represented by the Formula 1' and the second sagging amount curve represented by the Formula 2', where L'=W', Ze'=ZPL', rf1'=0.7, rf2'=1.2, Condition 2': Assuming that an intersection between the curve C2' and the useful area end of the inner surface of the panel is P2', a distance from the point P1' to the point P2' in a minor axis direction is H2', and a sagging amount at the point P2' with respect to the point P1' is ZP2', at least 60% portion of the sagging amount change curve along the curve C2' between the point P1' and the point P2' is present between the first sagging amount curve represented by the Formula 1' and the second sagging amount curve represented by the Formula 2', where L'=H2', Ze'=ZP2', rf1'=−0.4, rf2'=0.

5. The color picture tube according to claim 4, wherein a sagging amount change curve along a curve C3' on the inner surface of the panel, which a plane passing through the center P0' of the panel and parallel to the tube axis and the minor axis crosses, satisfies the following Condition 3', and a sagging amount change curve along a curve C4' on the inner surface of the panel, which a plane passing through the major axis end PL' and parallel to the tube axis and the minor axis crosses, satisfies the following Condition 4':

Condition 3': Assuming that an intersection between the curve C3' and the useful area end of the inner surface of the panel is a minor axis end PS', a distance from the center P0' to the minor axis end PS' along the minor axis is H3', and a sagging amount at the minor axis end PS' with respect to the center P0' is ZPS', at least 60% portion of the sagging amount change curve along the curve C3' between the center P0' and the minor axis end PS' is positioned on a side where a sagging amount is larger with respect to the first sagging amount curve represented by the Formula 1', where L'=H3', Ze'=ZPS', rf1'=0.2, Condition 4': Assuming that an intersection between the curve C4' and a diagonal line of the panel is a diagonal end PD', a distance from the major axis end PL' to the diagonal end PD' in the minor axis direction is H4', and a sagging amount at the diagonal end PD' with respect to the major axis end PL' is ZPD', at least 60% portion of the sagging amount change curve along the curve C4' between the major axis end PL' and the diagonal end PD' is present between the first sagging amount curve represented by the Formula 1' and the second sagging amount curve represented by the Formula 2', where L'=H4', Ze'=ZPD', rf1'=−0.4, rf2'=0.

6. The color picture tube according to claim 4, wherein assuming that a thickness of the panel at the center P0' is $T_C$, and a thickness of the panel at the diagonal end PD' of the useful area is $T_D$, a relationship: $T_D/T_C<2.1$ is satisfied, and a transmittance of the panel at the center P0' is 40 to 60%.

* * * * *